US008950898B2

(12) United States Patent
Catalano

(10) Patent No.: US 8,950,898 B2
(45) Date of Patent: Feb. 10, 2015

(54) RECESSED CAN DOWNLIGHT RETROFIT ILLUMINATION DEVICE

(75) Inventor: Anthony Catalano, Boulder, CO (US)

(73) Assignee: Terralux, Inc., Longmont, CO (US)

( * ) Notice: Subject to any disclaimer, the term of this patent is extended or adjusted under 35 U.S.C. 154(b) by 552 days.

(21) Appl. No.: 13/293,372

(22) Filed: Nov. 10, 2011

(65) Prior Publication Data

US 2012/0113642 A1 May 10, 2012

Related U.S. Application Data

(60) Provisional application No. 61/412,096, filed on Nov. 10, 2010.

(51) Int. Cl.

| | |
|---|---|
| ***F21V 21/00*** | (2006.01) |
| ***F21S 8/02*** | (2006.01) |
| ***F21V 23/00*** | (2006.01) |
| *F21V 23/04* | (2006.01) |
| *F21Y 101/02* | (2006.01) |
| *F21V 29/00* | (2006.01) |

(52) U.S. Cl.

CPC . *F21S 8/02* (2013.01); *F21V 23/00* (2013.01); *F21S 8/026* (2013.01); *F21V 23/0442* (2013.01); *F21Y 2101/02* (2013.01); *F21V 29/2293* (2013.01)

USPC ..... 362/249.02; 362/276; 362/294; 362/364; 362/365; 362/373

(58) Field of Classification Search

CPC ..... F21S 8/02; F21S 8/026; F21V 29/004; F21V 29/2293; F21Y 2101/02

USPC ..... 362/249.02, 249.05, 276, 294, 364, 362/365, 373

See application file for complete search history.

(56) References Cited

U.S. PATENT DOCUMENTS

| | | | | |
|---|---|---|---|---|
| 5,410,453 | A | 4/1995 | Ruskouski | |
| 5,836,677 | A | 11/1998 | Connors et al. | |
| 6,095,671 | A * | 8/2000 | Hutain | 362/373 |
| 6,168,285 | B1 | 1/2001 | Flohre | |
| 6,168,299 | B1 | 1/2001 | Yan | |
| 6,350,046 | B1 | 2/2002 | Lau | |
| 6,739,734 | B1 | 5/2004 | Hulgan | |
| 6,755,559 | B2 | 6/2004 | Wang et al. | |
| 7,001,039 | B1 | 2/2006 | Aubrey | |
| 7,026,923 | B2 | 4/2006 | Martin | |

(Continued)

FOREIGN PATENT DOCUMENTS

| | | |
|---|---|---|
| DE | 09/014794 | 2/2010 |
| WO | WO-2008/051957 | 5/2008 |

(Continued)

OTHER PUBLICATIONS

International Search Report and Written Opinion mailed Apr. 5, 2012 for International Application No. PCT/US2011/060101 (11 pages).

*Primary Examiner* — Stephen F Husar

(74) *Attorney, Agent, or Firm* — Morgan, Lewis & Bockius LLP

(57) ABSTRACT

In various embodiments, an illumination device includes driver and LED lighting modules collectively sized to fit within a recessed-can lighting fixture constructed for use with incandescent or halogen bulbs, thereby facilitating LED changeover without removal and replacement of the fixture.

80 Claims, 2 Drawing Sheets

(56) References Cited

U.S. PATENT DOCUMENTS

| | | | | |
|---|---|---|---|---|
| 7,318,661 | B2 | 1/2008 | Catalano | |
| 7,473,005 | B2 * | 1/2009 | O'Brien | 362/148 |
| 7,507,001 | B2 | 3/2009 | Kit | |
| 7,628,504 | B2 | 12/2009 | Glickman | |
| 7,644,508 | B1 | 1/2010 | Schmitz | |
| 7,646,029 | B2 | 1/2010 | Mueller et al. | |
| 7,677,770 | B2 | 3/2010 | Mazzochette | |
| 2004/0189218 | A1 | 9/2004 | Leong et al. | |
| 2008/0232116 | A1 | 9/2008 | Kim | |
| 2008/0285291 | A1 | 11/2008 | Fornari | |
| 2009/0135608 | A1 | 5/2009 | Sell | |
| 2009/0207603 | A1 | 8/2009 | Lydecker et al. | |
| 2010/0061108 | A1 | 3/2010 | Zhang et al. | |
| 2010/0109536 | A1 | 5/2010 | Jung et al. | |
| 2010/0110682 | A1 | 5/2010 | Jung et al. | |
| 2010/0110698 | A1 | 5/2010 | Harwood et al. | |
| 2010/0148673 | A1 | 6/2010 | Stewart et al. | |
| 2010/0327766 | A1 | 12/2010 | Recker et al. | |
| 2011/0026245 | A1 | 2/2011 | Lau | |

FOREIGN PATENT DOCUMENTS

| | | |
|---|---|---|
| WO | WO-2010/117813 | 10/2010 |
| WO | WO-2011/032059 | 3/2011 |

* cited by examiner

RECESSED CAN DOWNLIGHT RETROFIT ILLUMINATION DEVICE

RELATED APPLICATION

This application claims the benefit of and priority to U.S. Provisional Patent Application No. 61/412,096, filed Nov. 10, 2010, the entire disclosure of which is hereby incorporated herein by reference.

FIELD OF THE INVENTION

In various embodiments, the present invention relates to illumination devices, in particular illumination devices incorporating light-emitting diodes.

BACKGROUND

One of the most common light fixtures is the recessed can downlight (RCD), which is an open-bottom can that contains a light bulb, most commonly an incandescent bulb. The fixture is typically connected into the power mains at 120 to 277 volts, 50/60 Hz. RCDs are generally installed during the construction of a building before the ceiling material (such as plaster or gypsum board) is applied. Therefore, they are not easily removed or substantially reconfigured during their lifetime.

RCDs generally also accommodate incandescent light bulbs of various sizes (which, in a 4-inch-diameter RCD, include A19 (the common Edison-base bulb), PAR20, PAR16, R16, R20, etc., where the numerical designation refers to the diameter of the bulb and the letter to the bulb type or shape). These bulbs all have different overall dimensions (i.e., length, width, and diameter), and have varied light-distribution capabilities. For example, various bulbs have narrow, medium, or wide (flood) distributions. Therefore, the internal features of the RCD are constructed to accommodate many (if not all) various bulb types. Such features include mechanisms to adjust the vertical position of the bulb socket, as well as various "face plates" that cover the bottom of the fixture and provide a decorative finish that fits flush with the ceiling. Moreover, the face plate may contain a recessed reflector which channels and distributes the light. Because there are so many different light bulbs and finishes, there are a very large number of trim rings and optics combinations, in addition to the various spacers that accommodate the bulbs. Thus a complex arrangement of parts is needed for each RCD that is produced.

Because LEDs have very high efficiency (e.g., 100 lumens per watt compared to 10-15 lumens per watt for incandescent or halogen lights) and a long lifetime (e.g., 10,000-100,000 hours), they are attractive for virtually all lighting applications. However, even a dedicated LED-based downlight would have the disadvantage of only being compatible with new construction (without a prohibitively costly overhaul of an entire lighting system and related infrastructure), and thus would be unavailable for retrofitting into the large host of existing incandescent-based RCDs. Moreover, because the LED technology itself is rapidly changing, LED-based fixtures become obsolete as the LED technology, as well as the optics and cooling technology vital to performance, improve.

LED-based light bulbs represent a logical alternative. These products contain electronics, optics and heat sinks all in a form factor identical to that of the particular light bulb to be replaced. Such designs may be quite difficult to achieve, however, and generally necessitate strict control over power consumption in order to maintain low enough operating temperatures to avoid thermally-induced premature failure. Hence, the light output of such LED light bulbs is typically well below that of the incandescent light bulbs they replace. For example, a PAR20 LED lamp from Lighting Sciences has a rated output of 350 lumens while a conventional 50 watt PAR20 incandescent bulb has light output in the range of 600-750 lumens. Furthermore, replacement of the light bulb product means disposing and replacing the entire suite of electronics, optics, and heat sink—a costly and wasteful proposition.

Thus, there is a need for retrofit devices for RCDs based on LEDs that are compatible with a wide range of differently sized and/or shaped RCD fixtures, and that are easily upgradable with different light sources and/or associated electronics.

SUMMARY

Embodiments of the present invention advantageously enable retrofitting of a standard incandescent- or halogen-based RCD and also simplify and reduce the cost of eventual upgrades as the technology is improved. Such embodiments have some or all of the following advantages:

1) Modularization of the electronics, optics and cooling elements.

2) Backward compatibility to existing RCDs.

3) Upgradable in the field as the technology evolves.

4) Reduction in the number of products needed across platforms.

5) Compatibility with existing light-bulb bases without being limited by them.

6) Independent of the light bulb being replaced yet conforming to the volume of existing RCD fixtures.

Embodiments of the invention typically include a discrete driver module featuring circuitry for supplying power to and controlling the LED light source(s) and a plug-compatible base (i.e., a connector compatible with a socket for an incandescent or halogen light bulb, e.g., an A19 Edison-style base). The driver module is electrically connected to a discrete light module featuring at least one LED and a mechanism for mounting within an RCD fixture. The two modules are generally linked by an electrical cable that provides the electrical connection therebetween; preferably, this cable represents the sole physical link between the modules. As utilized herein, the terms "cable" and "electrical cable" refer to any one or more cables, wires, or other conduits for the conduction of electrical signals and/or electrical power.

In various embodiments of the invention, the lighting module incorporates a temperature sensor for sensing the temperature of the LED(s) and/or the ambient temperature, and the driver module incorporates thermal-feedback circuitry for controlling power supply to the LED(s) based on the sensed temperature. The lighting module may incorporate an integral or removable heat sink, and the heat sink may fit within a trim ring. The trim ring may have vents that substantially conceal the heat sink but permit air circulation and/or convection. The heat sink may not be physically or thermally connected to the driver module, and it may be supplemented or replaced by an active cooling element (e.g., a fan or a Synjet module available from Nuventix, Inc. of Austin, Tex.).

In various embodiments, the electrical cable connecting the two discrete modules has sufficient and/or adjustable length, thereby permitting the retrofit of a variety of differently sized RCD fixtures with the same driver and lighting modules. The lighting module and/or optional optics therefor may be positionable, e.g., on a gimbal mount enabling the aiming of the emitted light in a desired direction.

Thus, various embodiments of the present invention provide an LED light source that is backward-compatible with existing RCDs. Typical RCDs are designed to accommodate numerous light bulbs in a single fixture, but require numerous accessory parts to do so. In contrast, the LED-based retrofit in accordance with embodiments of the invention adjusts to a wide variety of RCD volumes without the need for accessory parts. Generally, the device utilizes a standard RCD shell and includes a trim ring (which may also be decorative) that permits convection and facilitates use of a replaceable lighting module. Thus, the device may be utilized in existing installations incorporating incandescent- and/or halogen-based RCDs.

In one aspect, embodiments of the invention feature an illumination device including or consisting essentially of a discrete driver module and a discrete lighting module that are collectively sized to fit within a recessed-can lighting fixture. The discrete lighting module is configured for electrical connection to but otherwise physically separate from the driver module. The discrete driver module includes or consists essentially of (i) circuitry for supplying power to and controlling at least one light-emitting diode and (ii) a connector compatible with a socket for an incandescent or halogen light bulb. The discrete lighting module includes or consists essentially of at least one light-emitting diode and a mechanism for mounting the lighting module within a recessed-can lighting fixture.

Embodiments of the invention feature one or more of the following in any of a variety of combinations. The lighting module may include a heat sink and/or an active cooling element. The illumination device may include a trim ring configured to overlap an edge of the lighting fixture and at least a portion of the lighting module. The trim ring may have a plurality of openings, thereby enabling convective cooling of the lighting module. The illumination device may include a light-emitting diode (which may be distinct from those light-emitting diodes on the lighting module for direct illumination) for emitting light through at least one of the openings, thereby providing decorative illumination. An electrical cable may electrically connect the driver module and the lighting module. The electrical cable may be the only physical connection between the driver module and the lighting module. The electrical cable may provide substantially no physical support to the lighting module. The electrical cable may be detachable from the driver module and/or the lighting module, thereby enabling replacement of the electrical cable with a second electrical cable having a different length. The lighting module may be detachable from the electrical cable, thereby enabling replacement of the lighting module with a second lighting module different from the lighting module. The mounting mechanism may include or consist essentially of one or more spring clip. The driver module may include an ambient temperature sensor and/or a temperature sensor for measuring the temperature of at least one of the light-emitting diodes(s) (i.e., the temperature resulting from heat generated during operation of the light-emitting diode(s)). The driver module may include circuitry for controlling current flow to the light-emitting diode(s) based on the measured temperature. The lighting module may lack circuitry for supplying power to and controlling the light-emitting diode(s).

In another aspect, embodiments of the invention feature a method of upgrading an illumination device disposed at least partially within a recessed-can lighting fixture comprising a socket for an incandescent or halogen light bulb. A discrete driver module is connected to the socket, the driver module including or consisting essentially of (i) circuitry for supplying power to and controlling at least one light-emitting diode and (ii) a connector compatible with the socket. A discrete lighting module is mounted within the recessed-can fixture, the lighting module including at least one light-emitting diode and being electrically connected to and otherwise physically separate from the driver module. The driver module and the lighting module collectively fit within the recessed-can lighting fixture.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. As used herein unless otherwise indicated, the terms "substantially" and "approximately" mean±10%, and, in some embodiments, ±5%. The term "consists essentially of" means excluding other materials that contribute to function, unless otherwise defined herein. Nonetheless, such other materials may be present, collectively or individually, in trace amounts.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
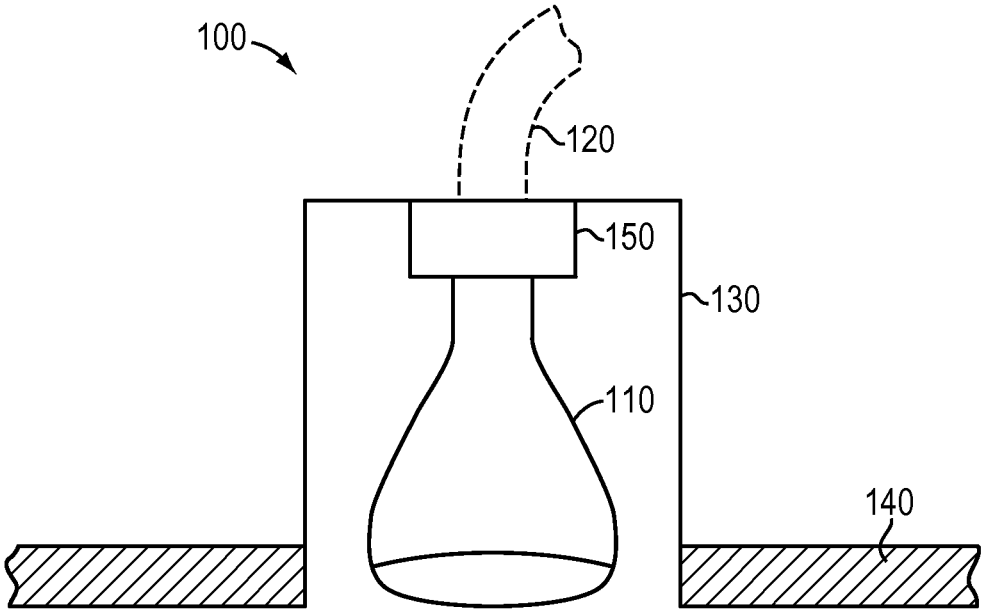
FIG. 1 PRIOR ART
FIG. 1 is a schematic cross-section of an RCD fixture in accordance with the prior art.

FIG. 1 depicts a standard RCD fixture 100 in accordance with the prior art. The fixture 100 typically houses and supplies electrical power to an incandescent or halogen light bulb 110, power being supplied via, e.g., an electrical conduit 120 connecting to the AC mains of the building in which the fixture 100 resides. The fixture 100 includes a can 130, which is typically recessed into a ceiling 140. The fixture 100 also includes an electrical socket 150 that is compatible with the electrical connector of the light bulb 110. As detailed above, retrofitting the fixture 100 for compatibility with a different type or size of light bulb 110 is difficult or impossible due to the fixed dimensions of the fixture 100.

Figure 2:
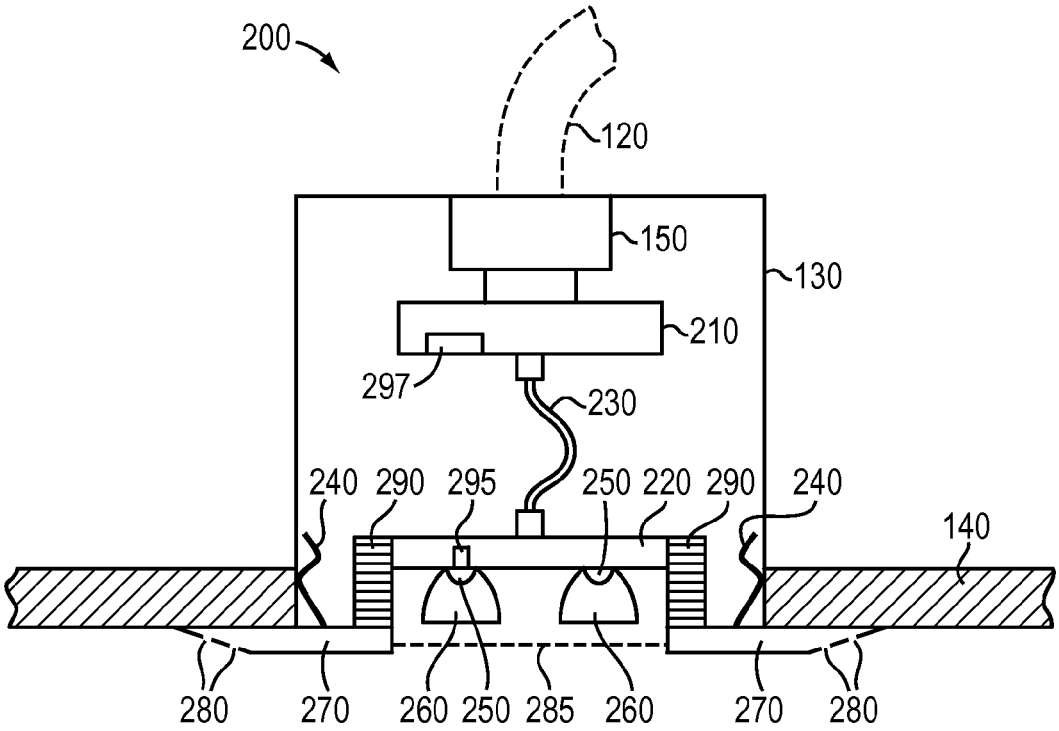
FIG. 2 is a schematic cross-section of an LED-based illumination device in accordance with various embodiments of the invention.

FIG. 2 depicts an illumination device 200 in accordance with various embodiments of the present invention. As shown, the illumination device 200 includes or consists essentially of a discrete driver module 210 and a discrete lighting module 220. The driver module 210 and lighting module 220 are collectively sized to fit within the RCD fixture or can 130, and may thus be utilized as a replacement lighting product for light bulb 110 shown in FIG. 1. The RCD fixture is typically cylindrical, and the cross-section of the fixture may be round, square, or have another shape. Generally the fixture is mounted to a structural element in a building, such as a ceiling beam, and may be connected to the building electrical system via electrical conduit 120 and an electrical junction box (not shown).

In preferred embodiments of the present invention, the driver module 210 and lighting module 220 are electrically connected, e.g., via an electrical cable 230, but are otherwise physically separate. The electrical cable 230 may thus be the only physical connection between modules 210, 220. As shown, cable 230 generally has a length sufficient to position the lighting module 220 proximate the opening of the RCD fixture but may have shorter or longer lengths, thereby facilitating the removal of at least a portion of device 200 from the RCD fixture and subsequent placement within a different RCD fixture having different dimensions, e.g., a different depth (i.e., of recess into the ceiling 140). Thus, in many embodiments of the invention the cable 230 provides substantially no physical support to the lighting module 220. Instead, the lighting module 220 is preferably positioned within the RCD fixture via a mounting mechanism 240, which may include or consist essentially of, e.g., one or more springs or spring clips (that may be coated to enhance their friction against the inner surface of the RCD fixture). The modular design of preferred embodiments of the present invention obviates the need for a dedicated "sleeve" or other insert housing the modules 210, 220 within the RCD fixture. The electrical cable 230 may be detachable from the driver module 210 and/or the lighting module 220, allowing for the replacement or upgrading of any of modules 210, 220 or cable 230. For example, the cable 230 may terminate in removable snap-in connectors at one or both ends.

The lighting module 220 features one or more LEDs 250, which may be packaged (e.g., with integrated optics and/or encapsulation) and/or substantially unpackaged (e.g., bare dies), and which may individually and/or collectively emit any of a variety of colors of light, including white light. An optic 260 (e.g., a refractive, diffusive, or focusing lens) may be integrally or removably connected to one or more of the LEDs 250 in order to direct the light emitted from the LEDs 250 in a particular direction or to give the light a desired pattern or color. As mentioned above, the entire lighting module 220 may be mounted, e.g., gimbal mounted, to facilitate aiming of the light emitted therefrom in a desired direction.

A trim ring 270 may provide a decorative cover to the interface between the ceiling 140 and the RCD fixture and preferably covers the seam therebetween. The trim ring 270 may also facilitate the exchange of air with the outside via one or more vents 280, e.g., louvers or a mesh grill, while obscuring portions of device 200 within the RCD fixture. In some embodiments, a decorative feature is created with such openings, e.g., an illumination pattern created from the light from one or more (in some embodiments dedicated) LEDs in the lighting module 220. (Such decorative illumination is preferably distinct from the direct illumination emanating directly from the LEDs 250 out of the RCD fixture.) The trim ring 270 may be attached to the mounting mechanism 240 and may also provide mechanical support for the lighting module 220. The lighting module 220 may be substantially flush-mounted to the trim ring 270 or may be recessed to reduce glare. The lighting module 220 may be removably attached to the trim ring 270 by one or more pins, clamps, or other suitable fasteners. As shown, the trim ring 270 typically overlaps the edge of the RCD fixture and at least a portion of the lighting module 220. Although in some embodiments the LEDs 250 and/or the optics 260 are directly visible within the RCD fixture, in other embodiments the trim ring 270 incorporates a screen 285, e.g., a diffusive screen, to reduce glare or to produce a desired lighting pattern and/or color.

A heat sink 290 is preferably integrally or removably attached to the lighting module 220 in order to facilitate conduction and/or convection of heat away from the LEDs 250. The heat sink 290 may have a plurality of fins or other projections that increase its surface area, and it may be supplemented or replaced by an active cooling element (e.g., a fan or a Synjet module available from Nuventix, Inc. of Austin, Tex.). Due to the physical separation between driver module 210 and lighting module 220, the heat sink 290 is typically neither physically nor thermally connected to the driver module 210.

In various embodiments of the present invention, the lighting module 220 also incorporates one or more temperature sensors 295 (e.g., thermistors or other sensors) that sense the operating temperature of the LEDs 250 and/or the ambient temperature within or immediately outside the RCD fixture. Thus, a temperature sensor may be directly thermally coupled to one or more of the LEDs 250. The sensed temperature may be utilized by the driver module 210 to control lighting module 220, as described below.

In other embodiments, one or more sensors 295 may be occupancy and/or ambient-light-level sensors, and lighting module 220 may feature these types of sensors instead of or in addition to the abovementioned temperature sensors. Such sensors 295, as known to those of skill in the art, detect motion of and/or heat from occupants of the room in which illumination device 200 is installed, and/or the level of ambient light in the room. The output(s) of such sensors 295 may also be utilized by the driver module 210 to control lighting module 220. For example, the driver module 210 may direct the LEDs 250 to illuminate when the level of ambient light decreases beyond a threshold level and/or when an occupant is detected in the room. Similarly, the driver module 210 may direct the LEDs 250 to dim or turn off entirely when the level of ambient light increases beyond a threshold level and/or when no occupant has been detected for a certain amount of time.

As shown in FIG. 2, the driver module 210 incorporates a connector that connects directly to (e.g., screws or plugs into) electrical socket 150 and receives electrical power (e.g., from the AC mains). The driver module 210 preferably contains electronics that transform such electrical power into a form suitable to drive the LEDs 250 (e.g., DC current). Driver module 210 may also include dimmers, transformers, rectifiers, or ballasts suitable for operation with the LEDs 250, as understood by those of skill in the art, and such components (and/or any other circuitry) of driver module 210 may be disposed on a printed circuit board. In preferred embodiments, the driver module 210 also provides for thermal feedback (or "foldback") to protect the LEDs 250, as described in, e.g., U.S. Pat. No. 7,777,430 and U.S. Patent Application Publication Nos. 2010/0320499, 2010/0176746 (the '6746 application), and 2011/0121760, the entire disclosures of which are incorporated by reference herein. For example, the driver module 210 may utilize the temperature sensed at the lighting module 220 to provide over-temperature protection (i.e., reduction in the power supplied to the LEDs 250) and/or switch and control any active cooling system (e.g., a fan) incorporated within lighting module 220 via, e.g., thermal control electronics 297. The driver module 210 may even incorporate features described in the '6746 application to enable two-wire temperature sensing and, thus, the maintaining of the LEDs 250 within a safe operating temperature range. The driver module 210 also typically provides electrical isolation from the mains power, and is self-contained and may incorporate other features such as a fuse. As shown in FIG. 2, power is supplied from the driver module 210 to the lighting module via the electrical cable 230.

The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. An illumination device comprising:

a discrete driver module comprising (i) circuitry for supplying power to and controlling at least one light-emitting diode, and (ii) a connector for electrically connecting to a source of power;

a discrete lighting module configured for electrical connection to but otherwise physically separate from the driver module, the lighting module comprising (i) at least one light-emitting diode, (ii) a mechanism for mounting the lighting module within a recessed-can lighting fixture, and (iii) a temperature sensor for measuring a temperature of the at least one light-emitting diode, wherein the driver module and the lighting module are collectively sized to fit within the recessed-can lighting fixture.

2. The illumination device of claim 1, wherein the lighting module comprises at least one of a heat sink or an active cooling element.

3. The illumination device of claim 1, further comprising a trim ring configured to overlap an edge of the lighting fixture and at least a portion the lighting module.

4. The illumination device of claim 3, wherein the trim ring comprises a plurality of openings, thereby enabling convective cooling of the lighting module.

5. The illumination device of claim 3, further comprising a light-emitting diode for emitting light through at least one of the openings, thereby providing decorative illumination.

6. The illumination device of claim 1, further comprising an electrical cable electrically connecting the driver module and the lighting module.

7. The illumination device of claim 6, wherein the electrical cable is the only physical connection between the driver module and the lighting module.

8. The illumination device of claim 6, wherein the electrical cable provides substantially no physical support to the lighting module.

9. The illumination device of claim 6, wherein the electrical cable is detachable from the driver module and the lighting module, thereby enabling replacement of the electrical cable with a second electrical cable having a different length.

10. The illumination device of claim 6, wherein the lighting module is detachable from the electrical cable, thereby enabling replacement of the lighting module with a second lighting module different from the lighting module.

11. The illumination device of claim 1, wherein the mounting mechanism comprises a plurality of spring clips.

12. The illumination device of claim 1, wherein at least one of the lighting module or the driver module comprises an ambient temperature sensor.

13. The illumination device of claim 1, wherein the driver module comprises circuitry for controlling current flow to the at least one light-emitting diode based on the measured temperature.

14. The illumination device of claim 1, wherein the lighting module lacks circuitry for supplying power to and controlling the at least one light-emitting diode.

15. The illumination device of claim 1, wherein the connector is compatible with a socket for an incandescent or halogen light bulb.

16. The illumination device of claim 1, wherein the source of power comprises power mains of a building.

17. The illumination device of claim 16, wherein the power mains operate at a voltage selected from the range of 120 volts to 277 volts.

18. The illumination device of claim 1, wherein the source of power comprises at least one of an electrical conduit or a junction box.

19. The illumination device of claim 1, wherein the recessed-can lighting fixture comprises at least one of a reflector or an electrical junction box therewithin.

20. The illumination device of claim 12, wherein at least one of the lighting module or the driver module comprises thermal control circuitry configured to provide over-temperature protection to the at least one light-emitting diode based at least in part on the ambient temperature.

21. The illumination device of claim 20, wherein the thermal control circuitry is configured to reduce power supplied to the at least one light-emitting diode based at least in part on the ambient temperature.

22. The illumination device of claim 20, wherein (i) the lighting module comprises an active cooling element, and (ii) the thermal control circuitry is configured to control the active cooling element based at least in part on the ambient temperature.

23. A method of upgrading an illumination device disposed at least partially within a recessed-can lighting fixture comprising an outlet electrically connected to a source of power, the method comprising:

connecting to the outlet a discrete driver module comprising (i) circuitry for supplying power to and controlling at least one light-emitting diode and (ii) a connector compatible with the outlet; and mounting within the recessed-can fixture a discrete lighting module (i) electrically connected to and otherwise physically separate from the driver module, (ii) comprising at least one light-emitting diode, and (iii) comprising a temperature sensor for measuring a temperature of the at least one light-emitting diode, wherein the driver module and the lighting module collectively fit within the recessed-can lighting fixture.

24. The method of claim 23, wherein the outlet comprises a socket for an incandescent or halogen light bulb.

25. The method of claim 23, wherein the source of power comprises power mains of a building.

26. The method of claim 25, wherein the power mains operate at a voltage selected from the range of 120 volts to 277 volts.

27. The method of claim 23, wherein the source of power comprises at least one of an electrical conduit or an electrical junction box.

28. The method of claim 23, wherein the recessed-can lighting fixture comprises at least one of a reflector or an electrical junction box therewithin.

29. The method of claim 23, wherein the lighting module comprises at least one of a heat sink or an active cooling element.

30. The method of claim 23, wherein an electrical cable electrically connects the driver module and the lighting module.

31. The method of claim 30, wherein the electrical cable is the only physical connection between the driver module and the lighting module.

32. The method of claim 30, wherein the electrical cable provides substantially no physical support to the lighting module.

33. The method of claim 30, wherein the electrical cable is detachable from the driver module and the lighting module, thereby enabling replacement of the electrical cable with a second electrical cable having a different length.

34. The method of claim 30, wherein the lighting module is detachable from the electrical cable, thereby enabling replacement of the lighting module with a second lighting module different from the lighting module.

35. The method of claim 23, wherein the lighting module is mounted at least in part with a plurality of spring clips.

36. The method of claim 23, wherein at least one of the lighting module or the driver module comprises an ambient temperature sensor.

37. The method of claim 36, wherein at least one of the lighting module or the driver module comprises thermal control circuitry configured to provide over-temperature protection to the at least one light-emitting diode based at least in part on the ambient temperature.

38. The method of claim 37, wherein the thermal control circuitry is configured to reduce power supplied to the at least one light-emitting diode based at least in part on the ambient temperature.

39. The method of claim 37, wherein (i) the lighting module comprises an active cooling element, and (ii) the thermal control circuitry is configured to control the active cooling element based at least in part on the ambient temperature.

40. The method of claim 23, wherein the driver module comprises circuitry for controlling current flow to the at least one light-emitting diode based on the measured temperature.

41. The method of claim 23, wherein the lighting module lacks circuitry for supplying power to and controlling the at least one light-emitting diode.

42. An illumination device comprising:

a discrete driver module comprising (i) circuitry for supplying power to and controlling at least one light-emitting diode, and (ii) a connector for connecting to a source of power;

a discrete lighting module configured for electrical connection to but otherwise physically separate from the driver module, the lighting module comprising (i) at least one light-emitting diode, and (ii) a mechanism for mounting the lighting module within a recessed-can lighting fixture; and an electrical cable electrically connecting the driver module and the lighting module, wherein (i) the driver module and the lighting module are collectively sized to fit within the recessed-can lighting fixture and (ii) the electrical cable is the only physical connection between the driver module and the lighting module.

43. The illumination device of claim 42, wherein the lighting module comprises at least one of a heat sink or an active cooling element.

44. The illumination device of claim 42, further comprising a trim ring configured to overlap an edge of the lighting fixture and at least a portion the lighting module.

45. The illumination device of claim 44, wherein the trim ring comprises a plurality of openings, thereby enabling convective cooling of the lighting module.

46. The illumination device of claim 44, further comprising a light-emitting diode for emitting light through at least one of the openings, thereby providing decorative illumination.

47. The illumination device of claim 42, wherein the electrical cable provides substantially no physical support to the lighting module.

48. The illumination device of claim 42, wherein the electrical cable is detachable from the driver module and the lighting module, thereby enabling replacement of the electrical cable with a second electrical cable having a different length.

49. The illumination device of claim 42, wherein the lighting module is detachable from the electrical cable, thereby enabling replacement of the lighting module with a second lighting module different from the lighting module.

50. The illumination device of claim 42, wherein the mounting mechanism comprises a plurality of spring clips.

51. The illumination device of claim 42, wherein at least one of the lighting module or the driver module comprises an ambient temperature sensor.

52. The illumination device of claim 51, wherein at least one of the lighting module or the driver module comprises thermal control circuitry configured to provide over-temperature protection to the at least one light-emitting diode based at least in part on the ambient temperature.

53. The illumination device of claim 52, wherein the thermal control circuitry is configured to reduce power supplied to the at least one light-emitting diode based at least in part on the ambient temperature.

54. The illumination device of claim 52, wherein (i) the lighting module comprises an active cooling element, and (ii) the thermal control circuitry is configured to control the active cooling element based at least in part on the ambient temperature.

55. The illumination device of claim 42, wherein at least one of the lighting module or the driver module comprises a temperature sensor for measuring a temperature of the at least one light-emitting diode.

56. The illumination device of claim 55, wherein the driver module comprises circuitry for controlling current flow to the at least one light-emitting diode based on the measured temperature.

57. The illumination device of claim 42, wherein the lighting module lacks circuitry for supplying power to and controlling the at least one light-emitting diode.

58. The illumination device of claim 42, wherein the connector is compatible with a socket for an incandescent or halogen light bulb.

59. The illumination device of claim 42, wherein the source of power comprises power mains of a building.

60. The illumination device of claim 59, wherein the power mains operate at a voltage selected from the range of 120 volts to 277 volts.

61. The illumination device of claim 42, wherein the source of power comprises at least one of an electrical conduit or a junction box.

62. The illumination device of claim 42, wherein the recessed-can lighting fixture comprises at least one of a reflector or an electrical junction box therewithin.

63. A method of upgrading an illumination device disposed at least partially within a recessed-can lighting fixture comprising an outlet electrically connected to a source of power, the method comprising:

connecting to the outlet a discrete driver module comprising (i) circuitry for supplying power to and controlling at least one light-emitting diode and (ii) a connector compatible with the outlet; and mounting within the recessed-can fixture a discrete lighting module (i) electrically connected to and otherwise physically separate from the driver module and (ii) comprising at least one light-emitting diode, wherein (i) the driver module and the lighting module collectively fit within the recessed-can lighting fixture, (ii) an electrical cable electrically connects the driver module and the lighting module, and (iii) the electrical cable is the only physical connection between the driver module and the lighting module.

64. The method of claim 63, wherein the lighting module comprises at least one of a heat sink or an active cooling element.

65. The method of claim 63, wherein the electrical cable provides substantially no physical support to the lighting module.

66. The method of claim 63, wherein the electrical cable is detachable from the driver module and the lighting module, thereby enabling replacement of the electrical cable with a second electrical cable having a different length.

67. The method of claim 63, wherein the lighting module is detachable from the electrical cable, thereby enabling replacement of the lighting module with a second lighting module different from the lighting module.

68. The method of claim 63, wherein the lighting module is mounted at least in part with a plurality of spring clips.

69. The method of claim 63, wherein at least one of the lighting module or the driver module comprises an ambient temperature sensor.

70. The method of claim 69, wherein at least one of the lighting module or the driver module comprises thermal control circuitry configured to provide over-temperature protection to the at least one light-emitting diode based at least in part on the ambient temperature.

71. The method of claim 70, wherein the thermal control circuitry is configured to reduce power supplied to the at least one light-emitting diode based at least in part on the ambient temperature.

72. The method of claim 70, wherein (i) the lighting module comprises an active cooling element, and (ii) the thermal control circuitry is configured to control the active cooling element based at least in part on the ambient temperature.

73. The method of claim 63, wherein at least one of the lighting module or the driver module comprises a temperature sensor for measuring a temperature of the at least one light-emitting diode.

74. The method of claim 73, wherein the driver module comprises circuitry for controlling current flow to the at least one light-emitting diode based on the measured temperature.

75. The method of claim 63, wherein the lighting module lacks circuitry for supplying power to and controlling the at least one light-emitting diode.

76. The method of claim 63, wherein the outlet comprises a socket for an incandescent or halogen light bulb.

77. The method of claim 63, wherein the source of power comprises power mains of a building.

78. The method of claim 77, wherein the power mains operate at a voltage selected from the range of 120 volts to 277 volts.

79. The method of claim 63, wherein the source of power comprises at least one of an electrical conduit or an electrical junction box.

80. The method of claim 63, wherein the recessed-can lighting fixture comprises at least one of a reflector or an electrical junction box therewithin.

* * * * *